US005975329A

United States Patent [19]

Schmitt

[11] Patent Number: 5,975,329

[45] Date of Patent: Nov. 2, 1999

[54] STORAGE ENCLOSURE

[76] Inventor: Robert D. Schmitt, 5995 S. Bannock St., Littleton, Colo. 80120

[21] Appl. No.: 08/844,735

[22] Filed: Apr. 21, 1997

Related U.S. Application Data

[60] Provisional application No. 60/016,243, Apr. 19, 1996.

[51] Int. Cl.[6] ..... B65D 43/00

[52] U.S. Cl. ..... 220/350

[58] Field of Search ..... 220/350, 345, 220/346

[56] References Cited

U.S. PATENT DOCUMENTS

| | | | |
|---|---|---|---|
| 467,035 | 12/1892 | Livingston . | |
| 2,056,572 | 10/1936 | Gibbs . | |
| 2,107,997 | 2/1938 | Horsley . | |
| 2,555,705 | 6/1951 | Schafer | 220/350 X |
| 2,657,873 | 11/1953 | Dittman et al. . | |
| 2,722,469 | 11/1955 | Kosovsky . | |
| 2,969,169 | 1/1961 | Botnick . | |
| 3,044,841 | 7/1962 | Hein . | |
| 3,249,273 | 5/1966 | Robinson . | |
| 3,603,519 | 9/1971 | Brown et al. . | |
| 4,094,416 | 6/1978 | Smith . | |
| 4,162,024 | 7/1979 | Shanley | 220/350 |
| 4,432,482 | 2/1984 | Beausoleil . | |
| 4,582,003 | 4/1986 | Valero . | |
| 4,805,794 | 2/1989 | Tsuchiya et al. . | |
| 5,143,229 | 9/1992 | LaCorte . | |
| 5,143,230 | 9/1992 | LaCorte . | |
| 5,193,726 | 3/1993 | Humphrey . | |

*Primary Examiner*—Steven Pollard
*Attorney, Agent, or Firm*—Brian D. Smith, P.C.

[57] ABSTRACT

A storage enclosure ideally suited for use under kitchen cabinets on the kitchen counter top is disclosed. The enclosure has a top, bottom, right and left side, as well as a roll-top lid. The roll-top lid is slidably received in grooves provided in the right and left sides of the enclosure, which enable the lid to be opened and closed in the normal fashion a roll-top lid is used. The enclosure also includes notches located at the ends of the grooves on the backside of the enclosure for enabling the roll-top lid to be easily removed from the enclosure. In addition, the leading edge of the roll-top lid is provided with a cutting blade for cutting sheet material which is dispensed from the enclosure.

2 Claims, 2 Drawing Sheets

STORAGE ENCLOSURE

CROSS REFERENCE TO RELATED APPLICATIONS

This application is a nonprovisional application claiming the benefit under 35 USC 119(e) of U.S. provisional application Ser. No. 60/016,243, filed on Apr. 19, 1996.

TECHNICAL FIELD OF THE INVENTION

The invention relates generally to storage enclosures, and more particularly to a storage enclosure having a roll-top lid which is ideally suited for use on a kitchen counter top.

BACKGROUND OF THE INVENTION

The prior art is replete with storage enclosures, or boxes using roll-top lids. In a search for such enclosures having features of the present invention, the following patents were found: U.S. Pat. Nos. 467,035; 2,107,997; 2,722,469; 3,044,841; 3,249,273; 4,432,482; 4,805,794 and 5,193,726.

As will be appreciated from a review of the foregoing patents, none discloses a roll-top lid-type storage enclosure for dispensing sheet material from a plurality of rolls of sheet material mounted in the enclosure. In addition, the preferred roll-type lid storage enclosure of the present invention has a quickly and easily removable roll-top lid as well as a cutting blade mounted on the forward or leading edge of the roll-top lid, the provision of which enables one to easily tear off a section of rolled sheet material such as aluminum foil and/or Saran wrap which may be dispensed from the enclosure.

SUMMARY OF THE INVENTION

The present invention provides a storage enclosure which is ideally suited for use under kitchen cabinets on the kitchen counter top. The enclosure has sidewalls, such as a top, bottom, right and left side, as well as a roll-top lid. The roll-top lid is slidably received in grooves (sliding means) provided in the right and left sides of the enclosure, which enable the lid to be opened and closed in the normal fashion a roll-top lid is used. The enclosure also includes notches located at the ends of the grooves on the backside of the enclosure also for slidably receiving the roll-top lid but additionally enabling the lid to be easily removed (actually slid out) from the enclosure. In addition, the leading edge of the roll-top lid is provided with a cutting blade (cutting means) for cutting sheet material which is dispensed from the enclosure.

BRIEF DESCRIPTION OF THE DRAWINGS

The invention will be more readily understood by reference to the accompanying drawings wherein like reference numerals indicate like elements throughout the drawing figures, and in which.

DETAILED DESCRIPTION OF A PREFERRED EMBODIMENT

Figure 1:
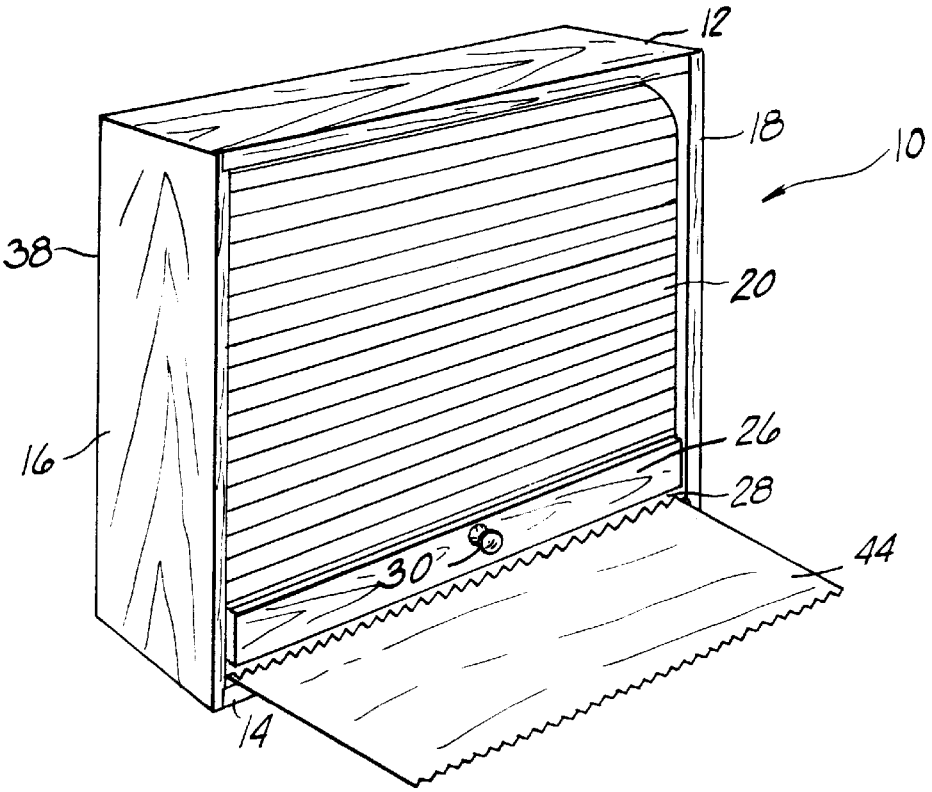
FIG. 1 is a perspective view of a storage enclosure of the present invention showing a sheet of material being dispensed from the enclosure which is ready to be torn, or otherwise separated from a roll of sheet material located inside the enclosure.
Figure 2:
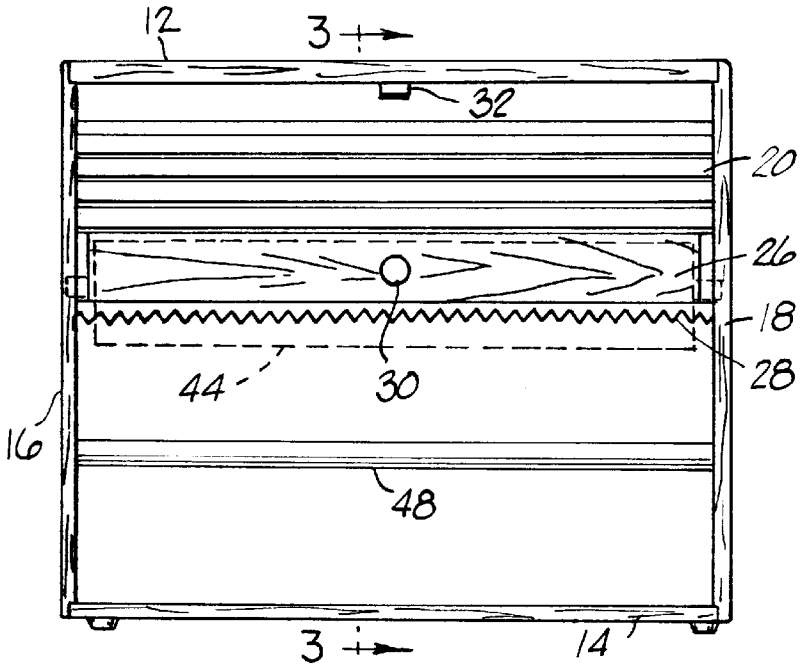
FIG. 2 is a front elevational view of the storage enclosure of FIG. 1 showing the roll-top lid as it would appear after it has been raised so that it is about halfway open.

FIGS. 1 through 4 illustrate a preferred embodiment of a storage enclosure 10 of the present invention. As shown, storage enclosure 10 has a top 12, bottom 14, left side 16, and right side 18. In addition, it will be appreciated that the enclosure has a roll-top lid 20 (flexible closure means), which is slidably received in grooves 22, 24 which are respectively provided in the left and right sides 16, 18. (Groove 22 is not shown in the drawings but it is identical to groove 24) Grooves 22, 24 could be replaced with any sliding means known to those skilled in the art for cooperating with the edges of the right and left sides and the lid to facilitate slidable movement of the lid along the sides. For example, other suitable sliding means include tracks such as those using ball bearings and even magnetic tape type systems for cooperating with the edges of the right and left sides and the lid to facilitate slidable movement of the lid along the sides.

It will also be appreciated that the lid has a forward, or leading edge member 26 to which a cutting blade 28 (cutting means) is attached, as shown. Leading edge 26 also has a knob 30 with which one can raise and/or lower the roll-top lid of the enclosure as desired.

Figure 3:
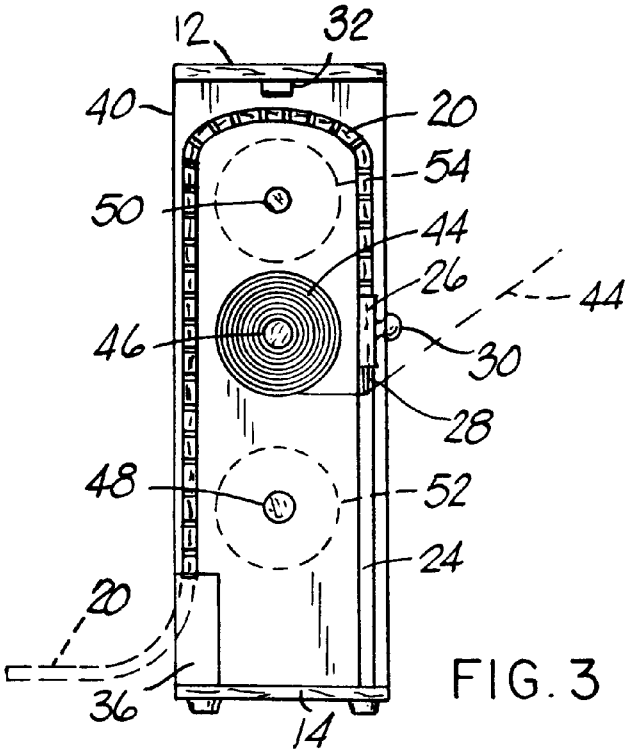
FIG. 3 is a cross sectional view taken along lines 3—3 of FIG. 2 which in dotted lines additionally shows a preferred position for tearing a sheet of material from its roll with the cutting blade attached to the forward edge of the roll-top lid. This view also shows in dotted line the roll-top lid as it would appear as it is being removed from the storage enclosure through a pair of notches located on the back side of the enclosure.

As perhaps best shown in FIG. 3, the underside surface (not numbered) of the top 12 is provided with a stop 32 which knob 30 abuts against when the roll-top lid is raised to its uppermost position. As those skilled in the art will appreciate, this slide limitation means provided by the cooperating knob 30 and stop prevents the roll-top lid from falling into the back of the enclosure.

Figure 4:
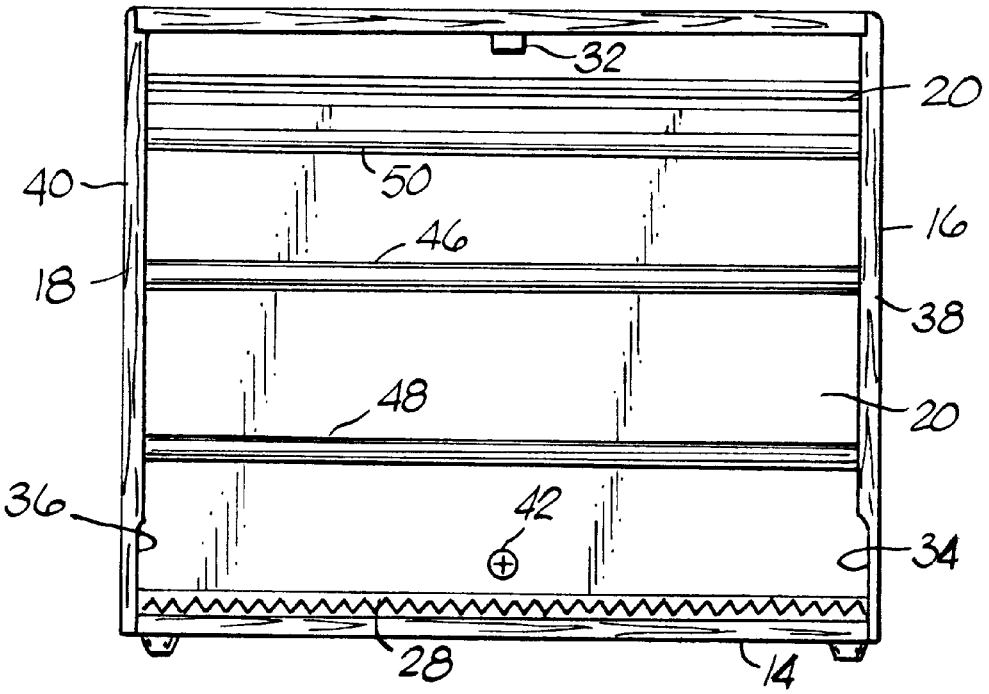
FIG. 4 is a rear elevational view of the storage enclosure of the previous figures which shows the pair of notches through which the roll-top lid is slid when it is desired to remove it from the enclosure.

As best shown in FIGS. 3 and 4, right and left sides 16, 18 are provided with notches 34, 36 (notch means) along their back edges 38 and 40 which are in communication respectively with grooves 22, 24. In accordance with an important aspect of the present invention, notches 34 and 36 enable one to quickly remove roll-top lid 20 when knob 30 is removed from the lid. Knob 30 is easily removed from the lid by unscrewing a screw 42, as shown in FIG. 4, which secures the knob to the leading edge 26 of the lid. With knob 30 removed, it will be appreciated that the roll-top lid can be quickly and easily removed from the enclosure by simply sliding it backwards in grooves 22, 24 and then out through notches 34, 36, as such is shown by the dotted line illustration of lid 20 in FIG. 3. Thus, a homemaker who desires to replace the roll-top lid of the enclosure with a new, perhaps differently colored roll-top lid can easily do this by simply removing knob 30 as previously described, and sliding the roll-top lid out of the storage enclosure through notches 34, 36.

To install a new roll-top lid, one simply carries out the aforementioned operation in reverse, i.e. the leading edge 26 of the new roll-top lid is inserted through notches 34, 36 and then slid forward through grooves 22, 24 to a point where knob 30 can be reattached to the leading edge.

The figures also illustrate that the enclosure can hold up to three rolls of sheet material. As best shown in FIG. 3, storage enclosure 10 is provided with a roll of sheet material 44, which is held by and dispensed from a middle rung 46 (roll holding means) of the enclosure. As also shown, storage enclosure 10 is provided with a lower rung 48 (roll holding means), and an upper rung 50 (roll holding means), both of which are provided for holding and dispensing other rolls 52, 54 of sheet material, shown in dotted lines. As will also be appreciated, the rolls mounted on the rungs will not interfere with the slidable movement of the lid between its open and closed positions because the lid follows a U-shaped path defined by the grooves which extends around the rungs and is spaced therefrom to prevent such interference, i.e. as long as conventionally sized rolls of sheet material are mounted on the rungs.

In accordance with a method of the present invention, sheet material 44 is dispensed and cut from its roll by simply unrolling the desired amount, and then tearing or cutting off the desired amount material by pulling upwardly on the sheet at approximately the angle illustrated in FIG. 3 which will cause cutting blade 28 attached to the leading edge 26 to cut the sheet material. This is easily accomplished, as shown in FIG. 3, by raising lid 20 to its midpoint position where it is approximately halfway open. At this point, the cutting edge or blade 28 will be roughly level with the bottom edge of the rolled sheet material. With the lid in this position, one can easily roll out the desired amount of sheet material, and cut it by pulling upwardly on it against blade 28 at an angle which as shown is about 30 degrees from the horizontal and which may range anywhere from about 15 to about 75 degrees from the horizontal. If desired, one can also lower or close the lid to the position illustrated in FIG. 1, at which point one can tear off the desired amount of sheet material by again pulling upwardly on the sheet as previously described.

Blade 28 does not have to be attached to the leading edge 26 of the lid to cut sheet material in accordance with the present invention. It could be mounted in the bottom 14 of the storage enclosure, perhaps in a recessed groove where it would also serve to cut the sheet material when, for example, the leading edge 26 of the lid is pressed downwardly against the blade and the desired section of sheet material is pulled to tear it from the roll. It will be appreciated that a blade mounted in such a recessed groove would project upwardly as opposed to blade 28 of the illustrated embodiment, which projects downwardly away from the leading edge 26 of the lid.

Roll-top lid 20 may be a conventional roll-top made out of slatted wood members which are connected by some sort of flexible material, or it could be any type of flexible surface which is capable of being slid in grooves 22, 24. The enclosure's top, bottom and sides may be made out of any material including wood, plastic and metal. Cutting blade 28 is preferably saw toothed as illustrated to minimize the possibility of being cut by the blade and the severity of such a cut if such were to happen. It is also preferably oriented relative to said leading edge of the lid such that the plane of said saw-toothed edge lies within the plane of said leading edge. This orientation of the blade will not interfere with the lid's quick removal from the enclosure, as previously described.

The invention has been described in detail with reference to a particular embodiment thereof, but it will be understood that various other modifications can be effected within the spirit and scope of this invention.

What is claimed is:

1. A method of removing a flexible closure member from a storage enclosure, said method comprising the steps of:

providing a storage enclosure, the storage enclosure including:

an enclosure having opposed right and left sides with an opening therebetween and a pair of opposed right and left grooves respectively defined by the right and left sides, each groove following a U-shaped path along its respective side, the right and left sides defining opposing notch means in communication with the grooves for permitting the flexible closure means to be slidably removed from the enclosure through the notch means;

flexible closure means slidably received in the right and left grooves for slidably moving between an open and a closed position, the flexible closure means covering the opening when it is in its closed position and permitting access to the enclosure through the opening when it is in its open position, the flexible closure means having a leading edge; and slide limitation means including a knob attached to the leading edge and stop means attached to the enclosure, the knob abutting against the stop means when the flexible closure means is in the open position to prevent the flexible closure means from further slidable movement in the grooves beyond the open position in the direction away from the closed position;

moving the knob and stop means relative to each other to prevent the knob from abutting against the stop means, so as to permit the flexible closure means to move beyond the open position and toward the notch means;

after said moving step, sliding the flexible closure means through the notch means to remove the closure means from the enclosure.

2. A method of removing a flexible closure member from a storage enclosure, as claimed in claim 1, in which said step of moving the slide limitation means includes removing the knob from the leading edge.

* * * * *